US007329187B1

(12) United States Patent
Holch et al.

(10) Patent No.: US 7,329,187 B1
(45) Date of Patent: Feb. 12, 2008

(54) CASHLESS COMPUTERIZED VIDEO GAME SYSTEM AND METHOD

(75) Inventors: Niels C. Holch, Annapolis, MD (US); Frank J. Riolo, Rome, NY (US)

(73) Assignee: Oneida Indian Nation, Oneida, NY (US)

( * ) Notice: Subject to any disclaimer, the term of this patent is extended or adjusted under 35 U.S.C. 154(b) by 405 days.

(21) Appl. No.: 09/921,782

(22) Filed: Aug. 6, 2001

Related U.S. Application Data

(63) Continuation of application No. 08/877,375, filed on Jun. 17, 1997, now Pat. No. 6,280,328, which is a continuation-in-part of application No. 08/719,651, filed on Sep. 25, 1996, now Pat. No. 5,674,128, which is a continuation of application No. 08/391,509, filed on Feb. 21, 1995, now abandoned.

(51) Int. Cl.
*A63F 9/24* (2006.01)

(52) U.S. Cl. ..... 463/42; 463/18

(58) Field of Classification Search ..... 463/16–18, 463/25, 20, 40, 42

See application file for complete search history.

(56) References Cited

U.S. PATENT DOCUMENTS

| | | | |
|---|---|---|---|
| 3,786,234 | A | 1/1974 | Trent et al. |
| 3,810,627 | A | 5/1974 | Levy |
| 3,909,002 | A | 9/1975 | Levy |
| 4,032,946 | A | 6/1977 | Wakatsuki et al. |
| 4,033,588 | A | 7/1977 | Watts |
| 4,108,361 | A | 8/1978 | Krause |
| 4,108,364 | A | 8/1978 | Tanaka et al. |
| 4,240,635 | A | 12/1980 | Brown |
| 4,275,456 | A | 6/1981 | Tanaka et al. |
| 4,283,709 | A | 8/1981 | Lucero et al. |
| 4,322,612 | A | 3/1982 | Lange |
| 4,323,770 | A | 4/1982 | Dieulot et al. |
| 4,335,809 | A | 6/1982 | Wain |
| 4,339,798 | A | 7/1982 | Hedges et al. |

(Continued)

FOREIGN PATENT DOCUMENTS

| | | | |
|---|---|---|---|
| EP | 0769769 | A1 | 4/1997 |

(Continued)

OTHER PUBLICATIONS

Instant Keno Specification; multiple drafts captioned "Keno" and "Instant Keno," undated (38 pages).

(Continued)

*Primary Examiner*—Robert E Pezzuto
(74) *Attorney, Agent, or Firm*—DeLizio Gilliam, PLLC

(57) ABSTRACT

Systems and methods consistent with the present invention allow a player to play a game of chance. In some embodiments, the method can include communicating, by the central controller, with the game terminals; receiving, by the central controller, requests for verification of account identifiers and player authentication information; verifying to the game terminals, by the central controller, that the account identifiers and the player authentication information are valid; receiving, by the central controller, game information from the game terminals for games for which wager amounts were received by the game terminals; and based on the game information, adjusting, by the central controller, player account information associated with the account identifiers.

20 Claims, 5 Drawing Sheets

U.S. PATENT DOCUMENTS 4,359,631 A 11/1982 Lockwood et al.
4,373,726 A 2/1983 Churchill et al.
4,467,424 A 8/1984 Hedges et al.
4,494,197 A 1/1985 Troy et al.
4,575,622 A 3/1986 Pellegrini
4,636,951 A 1/1987 Harlick
4,648,600 A 3/1987 Olliges
4,669,596 A 6/1987 Capers et al.
4,669,730 A 6/1987 Small
4,689,742 A 8/1987 Troy et al.
4,760,527 A 7/1988 Sidley
4,764,666 A 8/1988 Bergeron
4,815,741 A 3/1989 Small
4,832,341 A 5/1989 Muller et al.
4,856,787 A * 8/1989 Itkis ..... 273/237
4,875,164 A 10/1989 Monfort
4,880,237 A 11/1989 Kishishita
4,882,473 A 11/1989 Bergeron et al.
4,926,327 A 5/1990 Sidley
4,937,853 A 6/1990 Brule et al.
4,994,908 A 2/1991 Kuban et al.
5,007,649 A 4/1991 Richardson
5,038,022 A 8/1991 Lucero
5,042,809 A 8/1991 Richardson
5,083,271 A 1/1992 Thacher et al.
5,096,195 A 3/1992 Gimmon
5,119,295 A 6/1992 Kapur
5,135,224 A 8/1992 Yamamoto et al.
5,159,549 A 10/1992 Hallman, Jr. et al.
5,179,517 A 1/1993 Sabin et al.
5,192,854 A 3/1993 Counts
5,197,094 A 3/1993 Tillery et al.
5,223,698 A 6/1993 Kapur
5,235,509 A 8/1993 Mueller et al.
5,259,613 A 11/1993 Marnell, II
5,265,874 A 11/1993 Dickinson et al.
5,277,424 A 1/1994 Wilms
5,287,269 A 2/1994 Dorrough et al.
5,290,033 A 3/1994 Bittner et al.
5,297,802 A 3/1994 Pocock et al.
5,317,135 A 5/1994 Finocchio
5,321,241 A 6/1994 Craine
5,324,035 A 6/1994 Morris et al.
5,326,104 A 7/1994 Pease et al.
5,332,076 A 7/1994 Ziegert
5,348,299 A 9/1994 Clapper, Jr.
5,371,345 A 12/1994 LeStrange et al.
5,373,440 A 12/1994 Cohen et al.
5,408,417 A 4/1995 Wilder
5,429,361 A 7/1995 Raven et al.
5,440,108 A 8/1995 Tran et al.
5,457,306 A 10/1995 Lucero
5,470,079 A 11/1995 LeStrange et al.
5,475,205 A 12/1995 Behm et al.
5,491,326 A 2/1996 Marceau et al.
5,507,491 A 4/1996 Gatto et al.
5,524,888 A 6/1996 Heidel
5,536,008 A 7/1996 Clapper, Jr.
5,551,692 A 9/1996 Pettit et al.
5,559,312 A 9/1996 Lucero
5,575,374 A 11/1996 Orus et al.
5,580,310 A 12/1996 Orus et al.
5,580,311 A 12/1996 Haste, III
5,581,461 A 12/1996 Coll et al.
5,586,937 A 12/1996 Menashe
5,609,337 A 3/1997 Clapper, Jr.
5,613,680 A 3/1997 Groves et al.
5,613,912 A 3/1997 Slater
5,627,356 A 5/1997 Takemoto et al.
5,645,485 A 7/1997 Clapper, Jr.
5,655,961 A 8/1997 Acres et al.
5,655,966 A 8/1997 Werdin, Jr. et al.
5,674,128 A 10/1997 Holch et al.
5,697,482 A 12/1997 Orus et al.
5,722,890 A 3/1998 Libby et al.
5,732,398 A 3/1998 Tagawa
5,735,432 A 4/1998 Stoken et al.
5,737,418 A 4/1998 Saffari et al.
5,749,784 A 5/1998 Clapper, Jr.
5,755,621 A 5/1998 Marks et al.
5,761,647 A 6/1998 Boushy
5,762,552 A 6/1998 Vuong et al.
5,770,533 A 6/1998 Franchi
5,797,794 A 8/1998 Angell
5,800,269 A 9/1998 Holch et al.
5,810,664 A 9/1998 Clapper, Jr.
5,811,772 A 9/1998 Lucero
5,816,918 A 10/1998 Kelly et al.
5,823,879 A 10/1998 Goldberg et al.
5,830,067 A 11/1998 Graves et al.
5,830,068 A 11/1998 Brenner et al.
5,830,069 A 11/1998 Soltesz et al.
5,836,817 A 11/1998 Acres et al.
5,839,956 A 11/1998 Takemoto
5,857,911 A 1/1999 Fioretti et al.
5,902,983 A 5/1999 Crevelt et al.
5,917,725 A 6/1999 Thacher et al.
5,919,091 A 7/1999 Bell et al.
5,928,082 A 7/1999 Clapper, Jr.
5,949,042 A 9/1999 Dietz, II et al.
5,949,411 A 9/1999 Doerr et al.
5,952,640 A 9/1999 Lucero
5,959,277 A 9/1999 Lucero
5,971,271 A 10/1999 Wynn et al.
5,971,849 A 10/1999 Falciglia
5,984,779 A 11/1999 Bridgeman et al.
6,024,640 A 2/2000 Walker et al.
6,039,648 A 3/2000 Guinn et al.
6,048,269 A 4/2000 Burns et al.
6,049,823 A 4/2000 Hwang
6,050,487 A 4/2000 Bonifas
6,089,982 A 7/2000 Holch et al.
6,093,100 A 7/2000 Singer et al.
6,101,477 A 8/2000 Hohle et al.
6,110,041 A 8/2000 Walker et al.
6,113,495 A 9/2000 Walker et al.
6,120,024 A 9/2000 Lind
6,244,958 B1 6/2001 Acres
6,254,483 B1 7/2001 Acres
6,264,560 B1 7/2001 Goldberg et al.
6,280,328 B1 8/2001 Holch et al.
6,431,983 B2 8/2002 Acres
6,508,709 B1 1/2003 Karmarkar
6,729,957 B2 5/2004 Burns et al.
6,729,958 B2 5/2004 Burns et al.
6,736,725 B2 5/2004 Burns et al.
6,800,030 B2 10/2004 Acres
6,851,607 B2 2/2005 Orus et al.
2002/0166126 A1 11/2002 Pugh et al.

FOREIGN PATENT DOCUMENTS

WO WO 89/06998 8/1989
WO WO-9530944 11/1995
WO WO-9534040 12/1995
WO WO-97/44750 11/1997
WO WO-9840141 9/1998

OTHER PUBLICATIONS

Imagineering Systems, Inc., "Instant Keno—Cashless Automated Keno Writer Stations," undated (6 pages).
Imagineering Systems, Inc., "The Keno People," undated (2 pages).
Bruce T. Samboy letter to Hon. Richard F. Corbisiero, Jr. dated Jun. 1, 1994, "Review of Instant Keno" (6 pages).

Bruce T. Samboy letter to Carl Conti dated Jun. 13, 1994 (2 pages).
Bruce T. Samboy letter to Hon. Richard F. Corbisiero, Jr. dated Jun. 14, 1994, "Recommendations Concerning Instant Keno" (7 pages).
Katherine A. Smith letter to Hon. James R. Hurley dated Jun. 15, 1994, "Imagineering Computerized Keno System" (4 pages).
Jacqueline L. Minder letter to Ron Mach dated Jun. 20, 1994 (1 page).
Carl Conti letter to Bruce T. Samboy dated Jun. 27, 1994 (2 pages).
Bruce T. Samboy letter to Carl Conti dated Jul. 1, 1994, "Imagineering—Instant Keno and Gaming Enterprise Registration" (2 pages).
Niels C. Holch letter to Hon. Richard F. Corbisiero, Jr. dated Jul. 12, 1994 (1 page).
Hon. Richard F. Corbisiero, Jr. letter to Niels C. Holch dated Jul. 14, 1994 (1 page).
"High-Tech Gambling Debuts at Turning Stone," Syracuse Post Standard, Feb. 27, 1995 (1 page).
Turning Stone Inter-Office Memorandum to Bong Woo from Susan Gatley dated Oct. 17, 1994, re Instant Keno Issues (3 pages).
Turning Stone Inter-Office Memorandum to Bruce Samboy re Instant Keno, Observations and Recommendations, dated Nov. 8, 1994 (2 pages).
POT-O-GOLD, 19" Touchscreen Multi-Game Terminal Toucheasy Keno Play Description.
POT-O-GOLD, 19" Touchscreen Multi-Game Terminal Superpick Lotto Play Description.
POT-O-GOLD, 19" Touch screen Multi-Game Terminal Touch 6 Lotto Play Description.
POT-O-GOLD, 19" Touch screen Multi-Game Terminal Touch 6 Lotto Technical Description.
POT-O-GOLD, 19" Touchscreen Multi-Game Terminal Supergold Bingo Play Description.
"Amendment in the Nature of a Substitute H.R. 3125, Offered by Mr. Goodlatte of Virginia", no date.
"*AT&T Corp.* v. *Coeur D'Alene Tribe*, 45 F. Supp. 2d 995 (D. Idaho 1998)", (1998).
"Casino Systems Solutions", *IGT International Game Technology*, (1997).
"Casinolink", *Mikohn Worldwide* (4 pages), no date.
"Casinolink System", *Mikohn WorldWide* (8 pages), no date.
"H.R. 3125, 106th Congress. 2d Session", no date.
"Kenilworth-Systems: (KENS) Australia kicks off cashless gambling: Kenilworth signs contract valued at over $7 million", *Business Wire, 570 words*, (Apr. 27, 1988).
"New York Company Wagers That Cashless Betting Will Make it Flush", *Los Angeles Times, Dec. 28, 1990 Friday, Home Edition Business; Part D; p. 11; col. 1; Financial Desk* (*1182 words*), (Dec. 28, 1990).
"Oasis II", *CDS Systems and Services*, no date.
"QuickTrack", *Quick Track Gaming, Inc.* (44 pages), no date.
"S. 692, 106th Congress, 1st Session", no date.
"SafeJack", *Mikohn WorldWide* (15 pages), no date.
"Standing Stone Gaming: Open Gaming Protocol (OGP) Specification", *Integrated Performance Decisions, Version 2.1*, (Apr. 5, 1999), 1-58.
"Stockholders of Kenilworth Systems, in Chapter 7 liquidation, to receive exchange offer from CashTek", *Business Wire, Sep. 21, 1992* (*454 words*), (Sep. 21, 1992).
"TABARET A World First in Gambling Technology", no date.
"The Future of Gaming Today", *Casino Data Systems* (6 pages), no date.
"Welcome to Casino Data Systems", *Casino Data Systems* (5 pages), no date.
Banks, Michael A., "America Online: A Graphics-Based Success", *Link-UP*, (Feb. 1992),pp. 12, 14 and 15.
Yerak, Becky, "At Cashless Slots: You've got mail, and a jackpot", *USA Today*, (Nov. 13, 2000),2E.

* cited by examiner

CASHLESS COMPUTERIZED VIDEO GAME SYSTEM AND METHOD

RELATED APPLICATIONS

This application is a continuation of U.S. patent application No. 08/877,375, filed Jun. 17, 1997 now U.S. Pat. No. 6,280,328; which is a continuation-in-part of U.S. patent application No. 08/719,651, filed Sep. 25, 1996, now U.S. Pat. No. 5,674,128; which in turn is a continuation of U.S. patent application No. 08/391,509, filed Feb. 21, 1995, now abandoned. The contents of all the aforesaid applications are hereby incorporated by reference.

BACKGROUND OF THE INVENTION

This invention relates generally to the field of computer-controlled games, and more particularly to the field of control of banks of gaming devices and automated player tracking.

Electronic gambling is a popular activity. The parent application discusses a gambling system with terminals enabling players to choose from several games. Additionally, it keeps track of information deemed important by gaming establishments. The accumulated game information may be used to generate standard or customized reports for the gaming establishments. Periodic reports provide valuable information to the gaming establishments.

As in other businesses, comprehensive customer information such as player demographics and player activities are of great value to gaming establishments. Player information may be used for a wide array of purposes. The most ubiquitous application is marketing. Another is providing up-to-date information about each player at anytime. Gaming establishments may, for example, grant special incentives electronically to players exhibiting certain playing habits during the player's game. Additionally, instantaneous information would help gaming establishments detect fraud while it is occurring by reviewing comprehensive and current gaming information of a suspected player.

SUMMARY OF THE INVENTION

Systems and methods consistent with embodiments of the invention allow a player to play a game of chance. In embodiments, the method can include communicating, by the central controller, with the game terminals; receiving, by the central controller, requests for verification of account identifiers and player authentication information; verifying to the game terminals, by the central controller, that the account identifiers and the player authentication information are valid; receiving, by the central controller, game information from the game terminals for games for which wager amounts were received by the game terminals; and based on the game information, adjusting, by the central controller, player account information associated with the account identifiers. In some embodiments, the method can include receiving, at one of the game terminals, an account identifier and player authentication information associated with the account identifier; requesting, by the one of the game terminals, verification of the account identifier and the player authentication information from the central controller; receiving, at the one of the game terminals, verification of the account identifier and the player authentication information from the central controller; receiving, at the one of the game terminals, a wager amount for a game and a request associated with the account identifier to play the game; determining, at the one of the game terminals, a result of the game using random numbers; and transmitting, by the one of the game terminals, game information associated with the game and the account identifier to the central controller for the game for which the wager amount was received. In some embodiments, the system includes a plurality of game terminals configured to s receive account identifiers and player authentication information associated with the account identifiers, to request verification of the account identifiers and the player authentication information, and to transmit game information associated with the account identifiers for each game for which a wager amount associated with the account identifiers is received; and a central controller, connected to each of the plurality of game terminals, and including a database configured to store player account information for a plurality of players; an interface configured to receive account identifiers, the player authentication information, and the game information from the plurality of game terminals; and a processor configured to verify the account identifiers and the player authentication information, and to update the player account information, based on the received game information.

BRIEF DESCRIPTION OF THE DRAWINGS

The accompanying drawings, which are incorporated in and constitute a part of the specification, illustrate presently preferred implementations of the invention. Together with the general description given above and the detailed description of the preferred embodiments given below, the drawings explain the principles of the invention.

In the drawings.

DETAILED DESCRIPTION OF THE INVENTION

Reference will now be made in detail to the construction and operation of preferred implementations of the present invention illustrated in the accompanying drawings. In those drawings, like elements and operations are designated with the same reference numbers when possible.

The following description of the preferred implementations of the present invention is only exemplary of the invention. The present invention is not limited to these implementations, but may be realized by other implementations.

Figure 1:
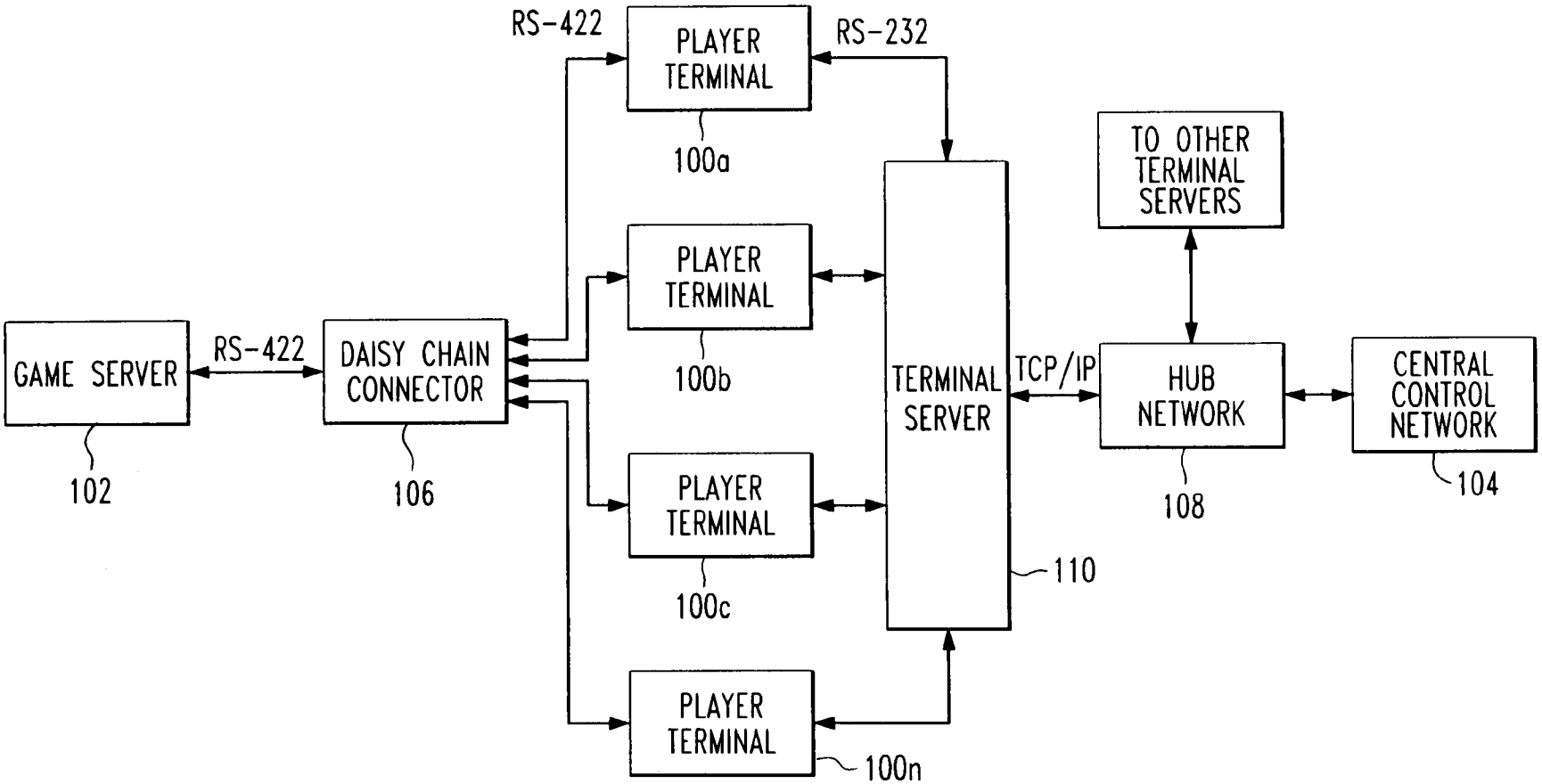
FIG. 1 is a block diagram of a system for operating several electronic games for several players in accordance with one embodiment of the present invention.

FIG. 1 shows a block diagram of a coinless video game system in accordance with a preferred embodiment of the present invention. As shown, the system generally comprises a plurality of player terminals 100*a*-100*n*, a game server 102 connected to each of the player terminals 100*a*-100*n*, and a central control network 104 connected to each player terminal for administering and controlling the player terminals 100 and for maintaining player accounts. Game server 102 preferably connects to the player terminals 100 via a daisy-chain connection 106 and communicates via the RS-422 protocol. The central control network 104 connects to each player terminal 100 via a hub network 108 and a terminal server 110.

In a preferred embodiment, the system also includes a terminal server 110 connected to each player terminal 100 and communicates via the RS-232 protocol. Terminal server 110 converts information from the player terminals 100 to the TCP-IP protocol and communicates the converted messages to the central control network 104 via the hub network 108. Hub network 108 preferably comprises an Ethernet network.

As shown in FIG. 1, a group of player terminals 100*a*-100*n* are serviced by a single game server 102 and a single terminal server 110. In a preferred embodiment, a single game server 102 and single terminal server 110 service up to thirty-two player terminals. Additional groups of player terminals (not shown) are connected to the central control network 104 via the hub network 108. As with the group of player terminals 100*a*-100*n*, any additional groups of player terminals are also preferably serviced by a single game server and are connected to the hub network via a single terminal server. Thus, in accordance with the present invention, a gaming system may comprise hundreds or thousands of player terminals. A single game server and a single terminal server service a group of player terminals, and central control network 104 controls all the groups of player terminals.

Figure 2:
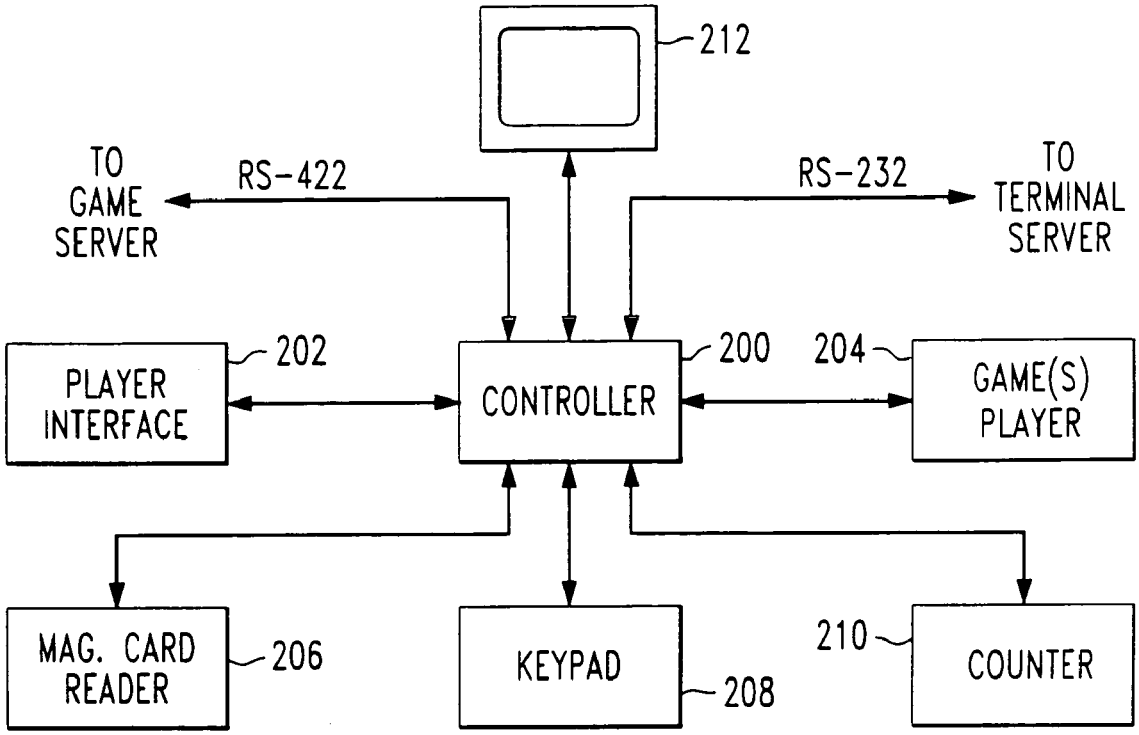
FIG. 2 is a block diagram of a player terminal in accordance with one embodiment of the present invention.

FIG. 2 illustrates a block diagram of a player terminal 100 in accordance with one embodiment of the present invention. Player terminals 100 differ from conventional electronic slot machine-type video game terminals because they do not receive coins and do not pay off winners with coins. Rather, in accordance with a preferred embodiment of the present invention, player terminals 100 accept a magnetic card or key (referred to generically as magnetic card), and communicate with the central control network 104 to debit and credit a player's account based on amounts wagered by the player for each game.

Referring to FIG. 2, player terminal 100 comprises a controller 200, player interface 202, game player 204, magnetic card reader 206, keypad 208, counter 210, and video display 212. Player interface 202 preferably comprises a software application for displaying attract mode graphics to attract a player to the player terminal. Game player 204 preferably comprises software applications running electronic games of chance, such as lotto, keno, bingo, etc. These games are preferably conventional video games of chance except that, as described below, they receive a random number from the external game server 102 and base a win/lose result on that random number and the player's selection. In accordance with the invention, each player terminal 100 plays any one of several games independently of the others. Thus, within a group of player terminals such as player terminals 100*a*-100*n*, several players may be playing keno while others play lotto and still others play video poker. Regardless of the game, the player terminals 100 look to the game server 102 for the random number to determine a result.

Magnetic card reader 206 preferably comprises a conventional magnetic card reader capable of reading a credit card- or smart card-type player identification card. The type of card will dictate the type of card reader.

Keypad 208 preferably comprises a conventional alphanumeric or numeric key entry device. Keypad 208 permits a player to enter a personal identification number ("PIN") to verify the player at the player terminal 100.

Video display 212 preferably comprises a conventional touch screen video monitor for displaying video graphics and receiving player inputs. A touch screen is not necessary, however, since player inputs can be made through keypad 208.

The counter 210 preferably comprises a conventional digital counting device for counting a predetermined interval between game plays. The counter 210 helps synchronize operation.

As described above, electronic games of chance rely on randomly generated numbers to determine wins and losses. Although the video games are preferably played by game player 204 at the player terminals, the random number from which the games player 204 determines wins and loses at each player terminal is generated by the game server 102 servicing those player terminals 100.

Figure 3:
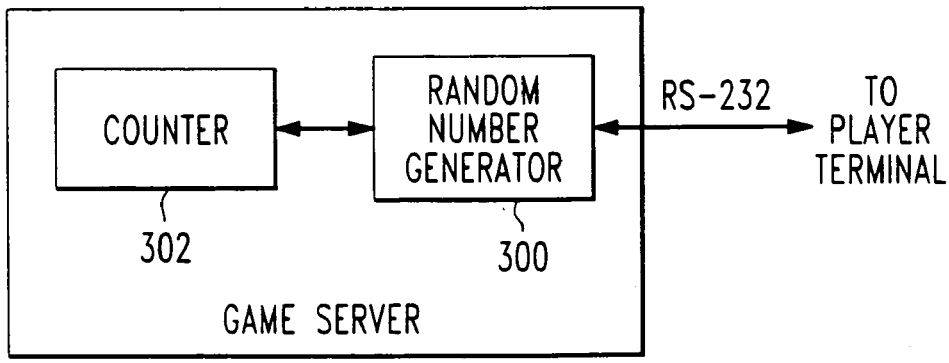
FIG. 3 is a block diagram of a game server in accordance with one embodiment of the present invention.

Thus, as shown in FIG. 3, game server 102 preferably comprises a random number generator 300 and a counter 302. Game server 102 preferably generates random numbers once during a predetermined period, e.g., every few seconds, as determined by counter 302. During a given predetermined period, if a players at player terminal 100 enters a wager and presses the "Play" button, the player must await the display of the next set of winning numbers. In the meantime, as soon as the "Play" button is selected, player terminal 100 notifies game server 102 and game server 102 enrolls that player terminal 100 in the next game.

Upon expiration of the predetermined period, game server 102 generates a set of random numbers for each type of game offered at player terminals 100 that it services. Game server 102 then sends the set of random numbers corresponding to the selected game at enrolled player terminal 100. Player terminal 100 receives the corresponding set of random numbers and determines the win or loss of that game. This eliminates the duplicative need for each player terminal 100 to convert the random number for the particular game being played, and simplifies the programming necessary at player terminal 100.

Each number in the generated set of random number may represent the winning number. For example, if keno is selected at player terminal 100 that is enrolled for the next game, game server 102 generates a set of twenty winning numbers. If the result of the game depends on a graphical figure, for example, Lucky Gem where three consecutive diamonds result in a winning jackpot, a predetermined number represents a certain shape of gem. To ensure proper randomization, however, game server 102 changes randomly or periodically the number corresponding to a certain graphical figure.

In another embodiment consistent with the present invention, game server 102 may generate a single set of random numbers and transmit them to player terminals 100. Player terminals 100 would then convert the single set of random numbers to game-specific numbers corresponding to the selected game at that terminal. This simplifies the tasks at game server 102 by generating only a single set of random numbers regardless of what games are selected at player terminals 100. Additionally, this embodiment alleviates the need for game server 102 to maintain enrollment information of player terminals 100. Player terminals 100 would, however, need to perform additional computation in converting the set of random numbers to game-specific numbers. In any event, the centralization of the random number generation provides an efficient and effective means for controlling the games, increases the average number of games played, and helps reduce fraud.

Because of the predetermined interval between generations of random numbers, a player who makes a "play" during that interval, must wait until that interval expires before the player terminal 100 receives the random number and determines a win or loss for that "play." The interval can, of course, be selected to be any predetermined interval to accommodate players and a provider of the system and games.

Figure 4:
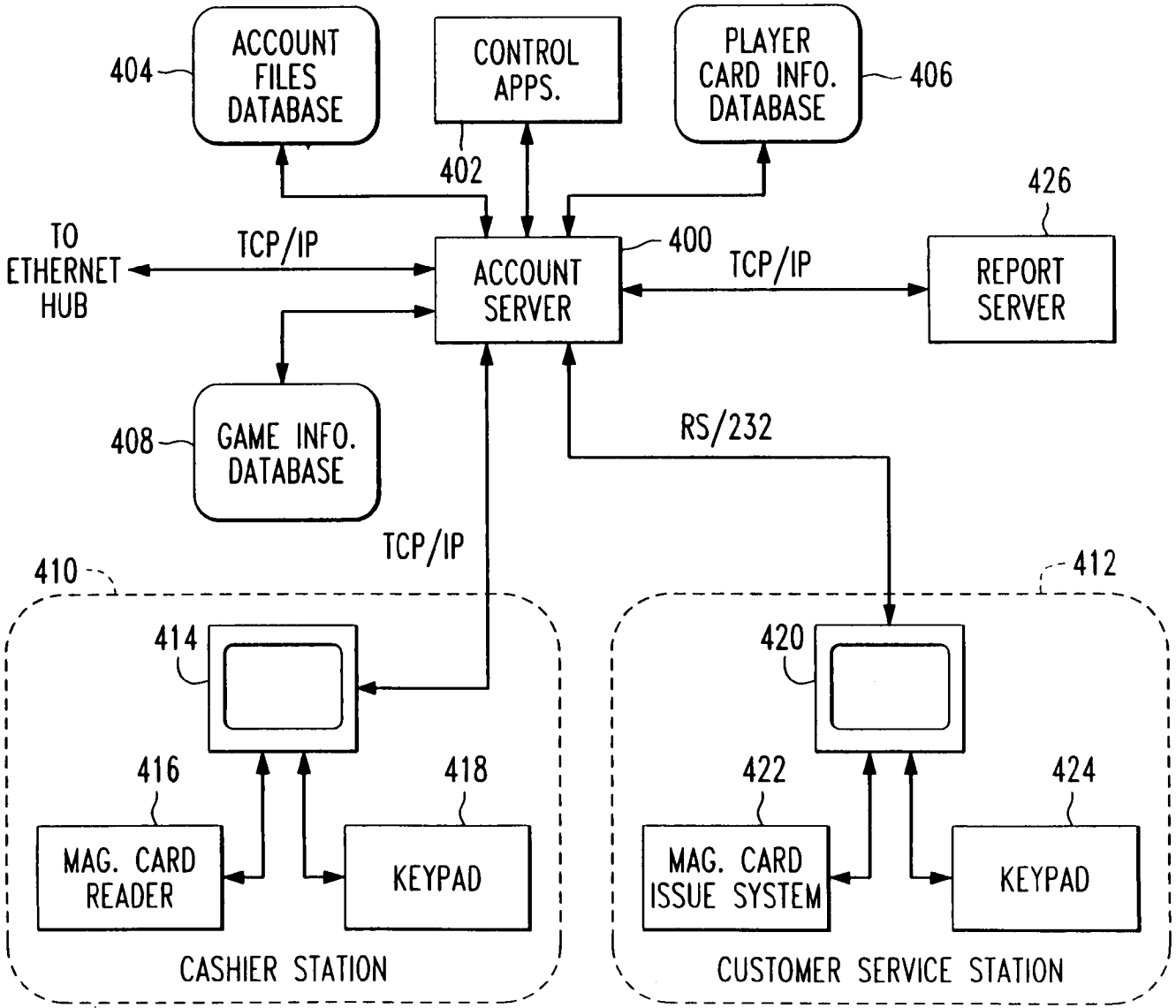
FIG. 4 is a block diagram of a central control network in accordance with one embodiment of the present invention.

In accordance with the present invention, central controller network 104 provides a centralized control means for monitoring and administering all video games and player accounts. Central controller network 104 tracks each player activity, preferably on a per-game basis, to maintain current and comprehensive information about the players at any time during the player'session at player terminals 100. FIG. 4 provides a block diagram of the central control network 104 in accordance with a preferred embodiment of the invention.

Central control network 104 preferably comprises an account server 400 running control applications 402 to provide the administrative and service functions described in this application. Account server 400 stores players' account information in an account files database 404, stores player card information in a player card information database 406, and stores game result information in a game information database 408. In addition, account server 400 preferably controls a cashier station 410 and a customer service station 412.

Cashier station 410 preferably comprises an operator terminal 414, connected to the account server via an Ethernet connection, a magnetic card reader 416, and a keypad 418. Customer service station 412 preferably comprises an operator terminal 420, connected to account server 400 via an RS-232 connection, a magnetic card issue system 422, and a keypad 424. Magnetic card reader 416 and issue system 422 preferably comprise conventional devices for reading and generating credit card-type magnetic cards. Likewise, keypads 418 and 424 preferably comprise conventional alphanumeric or numeric keypads, and terminals 414 and 420 preferably comprise conventional PC or networked data entry terminals.

Although the account server 400 is shown as a single element of the central control network 104, in a preferred embodiment account server 400 comprises a fault tolerant configured paired STRATUS R55 computer.

In addition to administering games and customer accounts, central control network 104 also provides reports on both using a report server 426. Account server 400 preferably trickles information from its transaction log file in its databases 404, 406, and 408 to the report server 426, which in turn generates customized or standardized reports in accordance with a service providers' requirements. Report server 426 may comprise, for example, a RS-6000 computer and/or an A/S 400. Each entry of the transaction log file preferably contains header information such as message type, transmission number, transaction code, and player account number to identify the type of message and transaction.

The transfer of information from account server 400 to report server 426 preferably occurs in real-time. Although only one physical connection may exist between account server 400 and report server 426, account server 400 may transfer the information in multiple logical units in parallel. This approach is desirable during peak times when transaction volume is high.

At service station 412, a player wishing to use a player terminal 100 can establish an account and receive a magnetic I.D. card to operate the player terminal 100. Preferably, a player provides an operator with some identifying information, and the operator uses terminal 420 to transmit this information to account server 400. Account server 400 establishes an account file for the player in account files database 404 and assigns a corresponding account number to that player. In addition, the operator may ask the customer to select a PIN via keypad 424. The player identifier information, the account number, and an encrypted version of the PIN is then stored on a magnetic strip on a magnetic I.D. card issued by the magnetic card issue system 422. Although not shown, customer service station 412 may also include a scanning device for scanning and storing a player's signature or photograph. Likewise, customer service station 412 may include a camera for photographing the player and including a picture on the player's I.D. card. Account server 400 stores the player's identification information in the player card information database 406. Such information may include the player's name, address, gender, birthday, and phone number. Any scanned information may be stored in a separate file server. Finally, the customer server status 412 may include a printer device to print, for example, customer receipts.

After receiving an I.D. card, the player proceeds to a cashier station 410 to deposit money into his or her account. An operator swipes the card through the magnetic card reader 416 to credit the account via the keypad 418 after receiving payment from the player. Account server 400 stores the player's account information in the account files database 404, preferably including the time, date, and amount of deposit as well as the resulting account balance.

Cashier station 410 also serves to pay players having positive account balances at the end of their play sessions. To receive money, a player provides an operator at cashier station 410 with his/her I.D. card. The operator swipes the I.D. card to retrieve the account balance information verifies the player by requesting the player to input his/her PIN via keypad 418, and pays the player any positive account balance. Account server 400 stores the player's account information in the account files database 404, preferably including the time, date, and amount of withdrawal as well as the resulting account balance. Although shown as two separate stations, cashier station 410 and customer service station 414 may be combined as a single customer service/cashier station.

To help illustrate the operation of the cashless video game system of the present invention, a preferred method of operation and system process will now be explained with reference to the system elements in block diagrams in FIGS. 1-4 and the process flow diagram shown in FIGS. 5*a* and 5*b*.

Figure 5A:
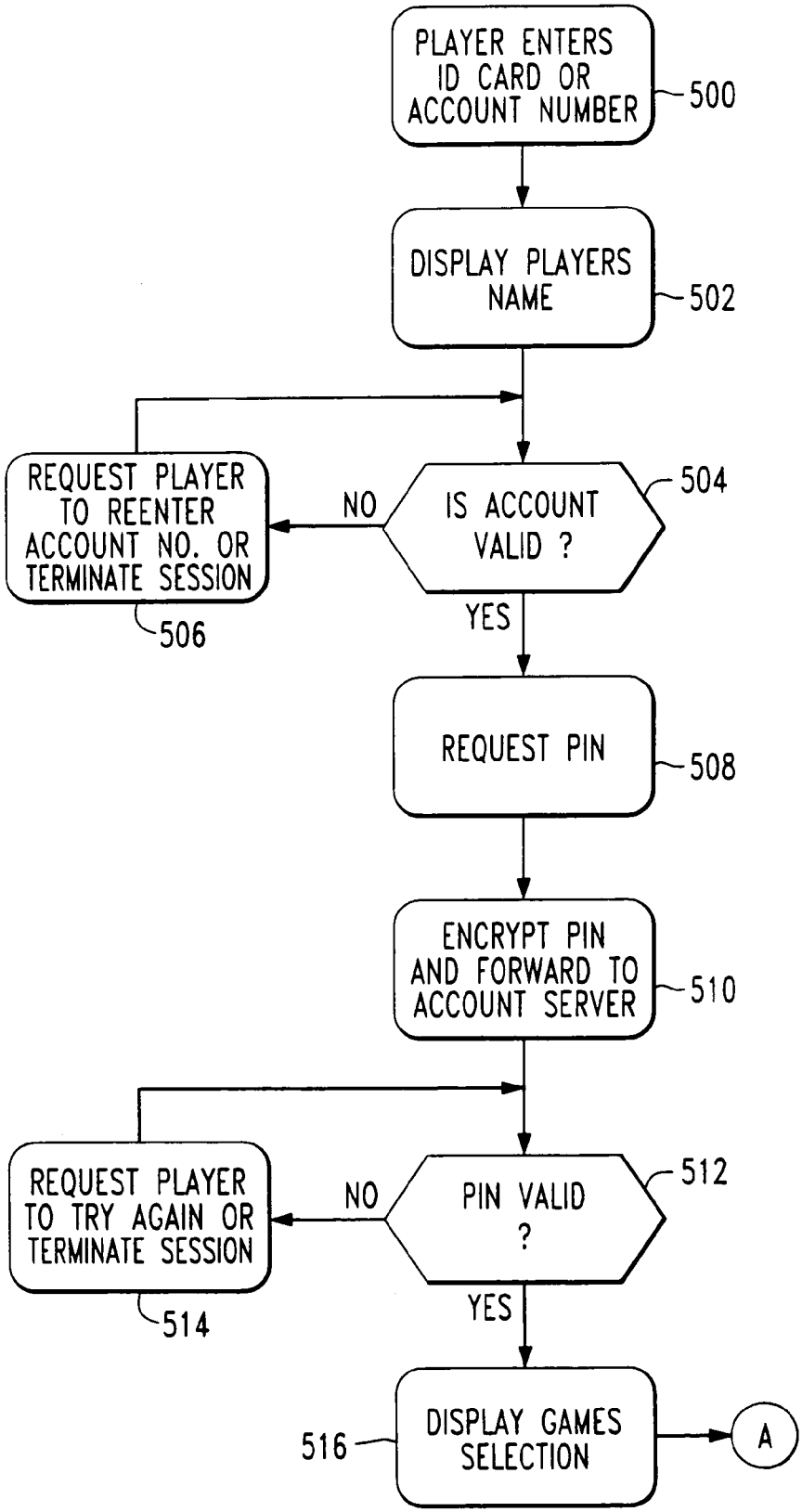
FIGS. 5*a* and 5*b* are process flow diagrams illustrating a method of operating a video game system in accordance with one embodiment of the present invention.
Figure 5B:
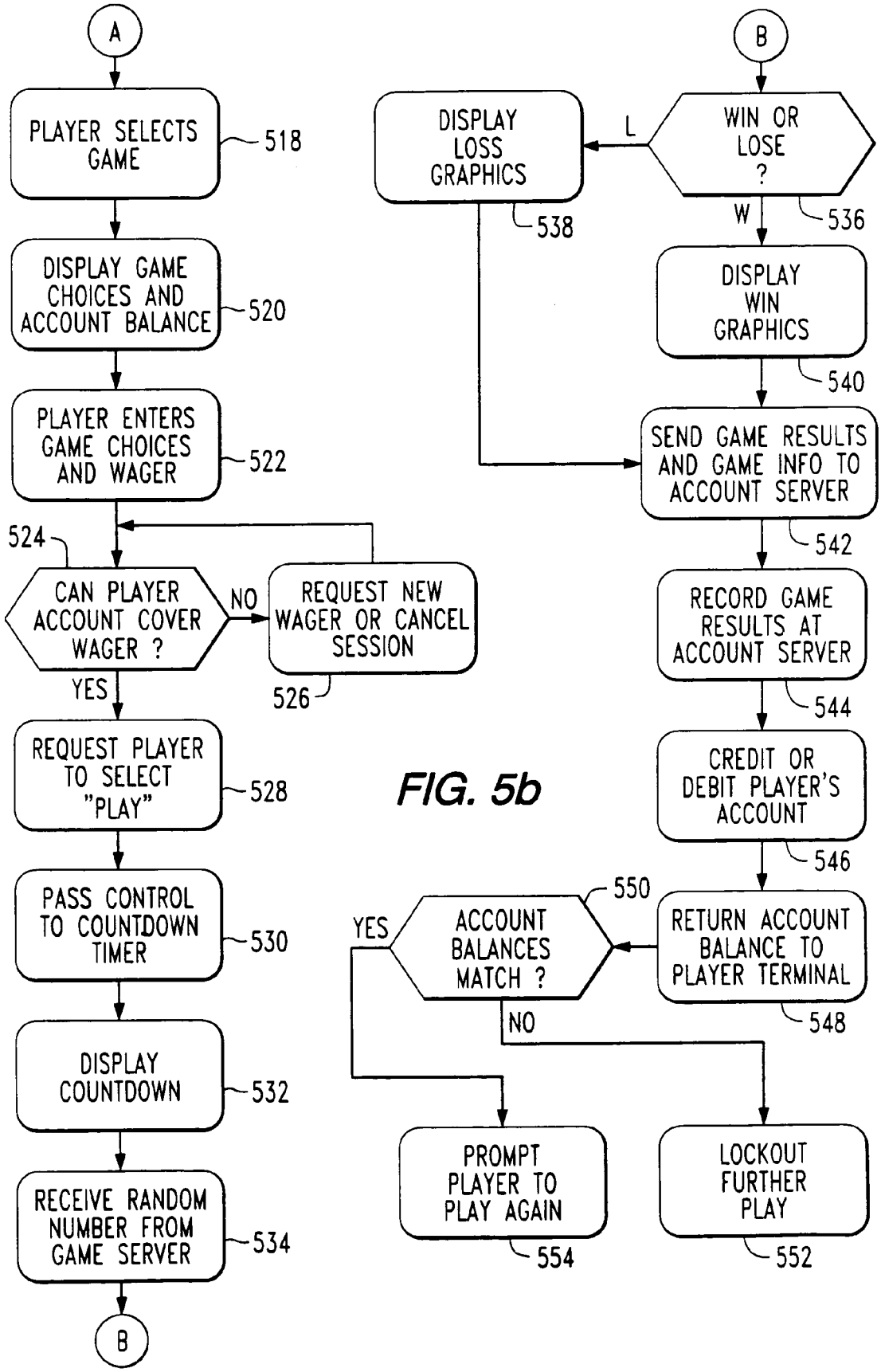

Referring to FIG. 5*a*, after opening a player account and obtaining a player I.D. card, a player logs onto a player terminal 100 by inserting the I.D. card into the magnetic card reader 206 (step 500). Alternatively, the system does not require player I.D. cards, so the player simply enters his/her assigned player account number using keypad 208.

The player terminal 100, which has been executing attract mode graphics, reads the information from the I.D. card, displays the player's name (step 502), sends the player account number to the account server 400, and requests the account server 400 to verify the player's account number. Account server 400 receives the account number and, referring to the account file database 404, determines whether the player account number is valid (step 504). If not, player terminal 100 informs the player and either requests the player to reenter the account number of terminates the session (step 506).

If account server 400 determines that the account number is valid, player terminal 100 requests the player to enter his/her PIN (step 508). Player terminal 100 preferably encrypts the PIN and forwards the encrypted PIN to the account server 400 (step 510). Account server 400 receives the PIN and determines whether the PIN is valid and corresponds to the player's account number (step 512). If the PIN is not valid or does not correspond to player's account number, player terminal 100 either requests the player reenter the PIN, or terminates the session (step 514). If the PIN is valid, player terminal 100 displays a graphical selection of video games on video display 212 (step 516). As described, the video games may include keno, lotto, bingo, etc.

Using the touch screen video display 212 or keypad 108, the player then selects a desired game (step 518). The player terminal 100 displays the corresponding game graphics and requests the player to enter game choices corresponding to that game (step 520). For a particular game, a player may have to make certain selections required by the rules of each game including a selection of predetermined numbers, colors, and/or symbols. For example, if the player selects keno, video display 212 may display eighty numbers from which the player selects up to twenty numbers via the video display screen 212. Player terminal 100 also displays the account balance during a player session.

The player then enters his/her game choices and a wager amount (step 522). In a preferred embodiment, video display 212 also displays the wager amount during each game. Player terminal 100 responds to the waged amount by requesting the account server 400 to verify that the player has a sufficient balance in his/her account to cover the wager.

When the account server 400 receives this request from the player terminals it makes the requested determination (step 524). If the player has insufficient funds to cover the wager, the player terminal 100 so informs the player and either requests the player to enter a new wager consistent with the player's account balance or terminates the session (step 526). If account server 100 determines that the account balance is sufficient to cover the wager, player terminal 400 informs the player that he/she is authorized to play and requests the player to select a "play" button on the video display 212 or keypad 208 (step 528). Once the player selects the "play" button, player terminal 100 passes control to counter 210 (step 530) and waits to receive a random number from the corresponding game server 102.

Again, as explained above, because game server 102 is generating a random number at a predefined interval, the player who has selected the "play" button during the interval must wait until the player terminal 100 receives the random number to determine the results of the play. Counter 210 in player terminal 100 keeps track of this interval and, in one embodiment, may display the time remaining between the player's selection of the "play" button and the determination of a win or loss (step 532).

As explained above, at the end of the interval, game server 102 generates a set of random numbers corresponding to each of the plurality of games at player terminals 100. Game server 102 transmits to each corresponding player terminal 100 the set of random numbers corresponding to the game being played to player terminal 100. Player terminal 100 receives the random number from the game server (step 534) and determines whether the player has won or lost that game (step 536). If the player has lost, the player terminal 100 displays preselected loss graphics explaining the losing results (step 538). If the player wins, player terminal 100 displays preselected win graphics explaining the winning results (step 540).

Win or lose, player terminal 100 sends the game result and game information to account server 400 (step 542). Such information may include, for example, the player terminal number, game type code, game number, time, date, wager amount, and resulting account balance. In accordance with certain requirements, some or all of this information may be encrypted in accordance with conventional encrypting techniques. As described below, player terminal 100 also maintains the player's account balance during a player session.

The account server 400 responds to the data from the player terminal 100 by recording the game information in the game information database 408 (step 544) and crediting or debiting the player's account the waged account (step 546). Account server 400 then preferably returns the updated account balance to the player terminal 100 (step 548). Player terminal 100 determines whether the returned account balance matches the account balance being tracked by the player terminal 100 (step 550). This additional monitoring of the player's account balance helps protect the game service provider and the player by reducing fraud and detecting balance inconsistencies as early as possible, ideally on a per-game basis. If the account balances do not match, the player terminal 100 may prevent the player from continuing, and request service assistance (step 522). If the account balances match, player terminal 100 preferably prompts the player to choose whether to play again (step 554).

When a player has finished playing, he/she exits the player terminal using an appropriate touch screen command on video display 212 or key on the keypad 208 and returns to the cashier station 410 to settle his/her account. As described, using cashier terminal 414, a cashier (not shown) requests the player account information from the account server 400 and redeems the balance of the player's account to the player.

In the preferred embodiment consistent with the present invention, player terminals 100 transmit real-time to account server 400 all player activity information input by the player. This information may include, for example, the player's account number, information on the game played, and the game choices selected by the player, the wager amount, the winning numbers provided by the game server 102, and a credit or debit request for crediting or debiting the player's account the wager amount. Account server 400 stores player activity information at account files database 404 and player card information database 406. The player card information includes player demographics data such as age, gender, and geographic location. Accordingly, central controller network 104 maintains a current and comprehensive player activity information and demographics of each player, which may be accessed at any time by authorized personnel.

Report server 426 may provide a report of varying specificity including a detailed listing of an individual player's activity for a specified time period, a summary of a player's activity over a period of time, actual number of games played by each player, and a summary of all players' activity on a particular day or over a period of time. Report server 426 generates these reports periodically, for example, once every two minutes. Server 426 may then generate a player activity report outlining player gambling habits such as frequency of plays, favorite games, nomination of player terminals, and average amount of wagers. Such player tracking report is valuable to casinos and players. Based on such reports, for example, casinos may tailor the types, number, and wager amount of games offered at player terminals 100 to accommodate player demand. Player terminals 100 may be modified periodically or interactively based on current player demand.

Additionally, casinos may use the reports as a tool to identify players with certain characteristics for marketing purposes. One marketing tool may be to offer "free play" cards, which are unique player cards with non-redeemable, playable credits. Such cards may be used as an incentive to attract players to the casino. Casinos may also offer complimentary "free play" cards to players who spend a certain weekly amount playing games. Player's account number along with expiration date and time of the free play cards may be printed on the card. Upon expiration such date and time, player terminals 100 will not recognize the free play card. Additionally, casinos may program cashier stations 410 to restrict withdrawals on the free play cards to only amounts greater than the face value of the card. The redemption period may also be restricted, for example, as a predetermined number of days after the expiration date.

Central tracking of all player activity on a per-game basis helps better tailor player terminals 100 based on player use and demand, reduce fraud, and target marketing efforts to players with certain attributes. Additionally, instantaneous information provides greater flexibility for managing gaming establishments. For example, such information may enable gaming establishment to access information whether player habits qualify for special awards during the play. It also helps detect fraud while it is occurring, for example, by detecting wins that far exceed average statistical odds or a single player playing at multiple player terminals 100 simultaneously. Moreover, real-time maintenance of player activity enables accurate system recovery in emergency situations such as power outage.

This description describes the presently preferred embodiments and methods of the present invention, but those skilled in the art would recognize that various changes and modifications may be made, and equivalents may be substituted without departing from the scope of the invention.

For example, the figures and description include a game server as a separate device for generating random numbers for the player terminals associated with that game server. Each player terminal could also maintain its own random number generator. In this embodiment, the random number generators in each player terminal would preferably be synchronized to provide a random number at a predetermined interval, just as described above for the separated random number generator in a game server. A random number generator could also be provided in the central control network 104 rather than in a separate game server.

In addition, many modifications may be made to adapt a particular element, technique or implementation to the teachings of the present invention without departing from the scope of the invention. Therefore, this invention should not be limited to the particular embodiments and methods disclosed herein, but that the invention include all embodiments falling within the scope of the appended claims.

We claim:

1. A method of operating games in a system that includes game terminals and a central controller, the method comprising:

communicating, by the central controller, with the game terminals;

receiving, by the central controller, requests for verification of account identifiers and player authentication information;

verifying to the game terminals, by the central controller, that the account identifiers and the player authentication information are valid;

receiving, by the central controller, game information from the game terminals for games for which wager amounts were received by the game terminals; and based on the game information, adjusting, by the central controller, player account information associated with the account identifiers.

2. The method of claim 1, wherein, for each game, one of the game terminals receives a wager amount associated with only one account identifier.

3. The method of claim 1, wherein the game information includes at least one of the result of the game, the wager amount, an updated account balance, a terminal number, a game type code, a game number, a date, a time, and player activity information.

4. The method of claim 1, wherein the random numbers are game-independent random numbers generated externally to the one of the game terminals.

5. The method of claim 1, wherein the player account information includes an account balance.

6. The method of claim 1, wherein the adjusting the player account information includes crediting the player account information when a player wins the game.

7. The method of claim 1, further comprising:

transmitting adjusted player account information to the game terminals.

8. A method of operating games in a system that includes game terminals and a central controller, the method comprising:

receiving, at one of the game terminals, an account identifier and player authentication information associated with the account identifier;

requesting, by the one of the game terminals, verification of the account identifier and the player authentication information from the central controller;

receiving, at the one of the game terminals, verification of the account identifier and the player authentication information from the central controller;

receiving, at the one of the game terminals, a wager amount for a game and a request associated with the account identifier, the request a request to play the game; and transmitting, by the one of the game terminals, game information associated with the game and the account identifier to the central controller.

9. The method of claim 8, further comprising:

receiving, by the one of the game terminals, another wager amount associated with the account identifier; and before the receiving of the other wager amount, receiving, from the central controller, an updated account balance associated with the account identifier.

10. The method of claim 8, further comprising:

displaying, by the one of the game terminals, the result of the game.

11. The method of claim 8 further comprising:

presenting, by the one of the game terminals, a choice of games to be played; and receiving, by the one of the game terminals, a selection of the game.

12. The method of claim 8, wherein the game information is transmitted for each game.

13. The method of claim 8, further comprising:

executing, by the one of the game terminals, application programs in response to externally-generated random numbers;

determining, by the one of the game terminals, a result of a game; and displaying, by the one of the game terminals, the result of the game.

14. The method of claim 8, wherein, for each game, the one of the game terminals receives a wager amount associated with only one account identifier.

15. A gaming system comprising:

a plurality of game terminals configured to receive account identifiers and player authentication information associated with the account identifiers, to request verification of the account identifiers and the player authentication information and to transmit game information associated with the account identifiers for each game for which a wager amount associated with the account identifiers is received; and a central controller, connected to each of the plurality of game terminals, and including a database configured to store player account information for a plurality of players;

an interface configured to receive account identifiers, the player authentication information, and the game information from the plurality of game terminals; and a processor configured to verify the account identifiers and the player authentication information, and to update the player account information, based on the received game information.

16. The gaming system of claim 15, the plurality of game terminals further configured to display results of wagering games.

17. The gaming system of claim 15, wherein the player account information includes account balances.

18. The gaming system of claim 15, wherein the plurality of game terminals are further configured to transmit information including at least one of the result of the game, the wager amount, an updated account balance, a terminal number, a game type code, a game number, a date, a time, and player activity information.

19. The gaming system of claim 18, the information being transmitted for each game.

20. The gaming system of claim 15, wherein the random numbers are game-independent random numbers generated externally to the plurality of game terminals.

* * * * *